US006715173B2

(12) United States Patent
Barman et al.

(10) Patent No.: US 6,715,173 B2
(45) Date of Patent: Apr. 6, 2004

(54) MODULAR SLEEP SYSTEMS WITH FRICTION-SECURED COMFORT UNIT

(75) Inventors: Bruce G. Barman, Greensboro, NC (US); William Freeman, High Point, NC (US); David Crist, Archdale, NC (US)

(73) Assignee: Sealy Technology LLC, Trinity, NC (US)

( * ) Notice: Subject to any disclaimer, the term of this patent is extended or adjusted under 35 U.S.C. 154(b) by 0 days.

(21) Appl. No.: 09/792,135

(22) Filed: Feb. 22, 2001

(65) Prior Publication Data

US 2002/0112291 A1 Aug. 22, 2002

(51) Int. Cl.[7] ..... A47C 27/00
(52) U.S. Cl. ..... 5/691; 5/411; 5/903; 5/925
(58) Field of Search ..... 5/411, 691, 722, 5/903, 925

(56) References Cited

U.S. PATENT DOCUMENTS

| | | | | | |
|---|---|---|---|---|---|
| 2,975,437 | A | | 3/1961 | Freeman | 5/351 |
| 3,049,729 | A | * | 8/1962 | Broyles | 5/200.1 |
| 3,256,535 | A | | 6/1966 | Anson et al. | 5/351 |
| 3,287,749 | A | | 11/1966 | Marsico | 5/351 |
| 3,493,980 | A | | 2/1970 | Haller | 5/531 |
| 3,950,800 | A | | 4/1976 | Garshfield et al. | 5/351 |
| 4,164,797 | A | | 8/1979 | Golembeck | 5/470 |
| 4,424,600 | A | | 1/1984 | Callaway | 5/470 |
| 4,449,261 | A | | 5/1984 | Magnusson | 5/465 |
| 4,809,375 | A | | 3/1989 | Bull | 5/465 |
| 4,955,095 | A | | 9/1990 | Gerrick | 5/446 |
| 5,111,544 | A | * | 5/1992 | Graebe | 5/485 |
| 5,428,852 | A | * | 7/1995 | Tenuta et al. | 5/690 |
| 5,488,746 | A | * | 2/1996 | Hudson | 5/500 |
| 5,621,931 | A | * | 4/1997 | Hamilton | 5/482 |
| 5,745,940 | A | * | 5/1998 | Roberts et al. | 5/727 |
| 6,023,803 | A | | 2/2000 | Barman | 5/716 |
| 6,163,907 | A | | 12/2000 | Larson | 5/691 |
| 6,272,707 | B1 | * | 8/2001 | Robrecht et al. | 5/724 |

* cited by examiner

*Primary Examiner*—Michael F. Trettel
(74) *Attorney, Agent, or Firm*—Roetzel & Andress

(57) ABSTRACT

A modular sleep system has a foundation unit, an support unit having an innerspring and a support surface covered with a friction material, and a comfort unit having compressible material encapsulated in a woven upholstery material which is engaged by the friction material on the support surface of the support unit to prevent lateral movement or sliding of the comfort unit relative to the support unit, without any fasteners between the support unit and the comfort unit. The comfort unit can be lifted vertically off of the support unit without release or use of any fasteners, to be turned over, fluffed or exchanged for a different comfort unit having different layers of internal materials, feature layers, and support characteristics.

47 Claims, 5 Drawing Sheets

MODULAR SLEEP SYSTEMS WITH FRICTION-SECURED COMFORT UNIT

FIELD OF THE INVENTION

The present invention pertains generally to support structures for sleeping, and to sleep systems which have combinations of support structures with varying support characteristics.

BACKGROUND OF THE INVENTION

Devices for supporting the human body while sleeping have evolved generally from pads, to pads in combination with or supported by springs such as the common mattress, and further in combination with stiffer springs such as in mattress foundations or box springs. In a conventional mattress, springs or coils are interconnected in a matrix array, and covered on each side with layers of padding and fabric. Much of the innovation in mattresses and box springs is in the area of spring design, seeking configurations which provide optimal support of the body, in combination with the padding layers. There are certain design constraints on mattresses innersprings, such as the gauge of wire of the coils, the diameter, height, and number of coils in the array.

There is greater design flexibility in the material layers which cover the springs. There are conventionally one or more layers of non-woven insulation material over the terminal ends of the coils, one or more layers of polymer foam, and a quilted upholstery material. Typically both sides of the innerspring are provided with multiple layers of polymer foams, fiber batting and fabric layers of upholstery material, although some one-sided mattresses have been made. In general, mattresses are turned over periodically to avoid the setting or compaction of the polymer foam and fibrous material layers. The coils of the innerspring will not generally take a set, or in other words permanently compress to a reduced overall height. Therefore, turning the mattress simply relieves the material layers from repeated compression to allow return to the original shape. Because of this established practice of turning the entire mattress to the opposing side, both sides must be equally constructed symmetrically, with the same layers of material. This adds significantly to both the material, weight and manufacturing costs of the products.

In a one-sided mattress, the underside of the mattress innerspring is covered only minimally with inexpensive non-woven material. Often, there are also included layers of foam materials to create the visual perception of a full two-sided mattress, but which do not contribute to the support or comfort function of the mattress. The padded or sleep side is preferably constructed with materials which will resist taking a set, such as polymer foams and synthetic fiber batts. These mattresses may suffer in quality from the need to eliminate fibrous cushioning material which will compress, such as wool, synthetic and natural fibers, cotton and polyester. Certain types of foam such as polyurethanes and latex (which may be particularly thick) are added to provide cushioning. However, the foam materials did not have the distinct feel and comfort properties of fiber based cushioning.

In recent years, a significant portion of the additional mattress padding has been placed in the so-called pillowtop, i.e., an enclosed panel containing multiple layers of various foams and fiber batting which is sewn or otherwise fixedly attached to both sides of the mattress innerspring. See, for example, U.S. Pat. No. 5,787,532. For permanent attachment to the mattress innerspring upholstery, a gusset is formed to extend from the underside of the pillowtop, which is sewn to a mating gusset of the mattress upholstery material, along a tape edge of the pillowtop. Placing most of the comfort forming material (specifically, the fibrous materials) in permanently attached pillowtops on both sides of the mattress also requires that the mattress be periodically turned over to maintain its original shape. This turning is made increasing difficult by greater numbers of layers of material, and by the sheer size and weight of the mattress. The approach also necessitates that equal numbers of compressible material layers be included on both sides of the innerspring, adding significantly to the cost of the mattress.

A large number of layers of material in the pillowtop, including high density foam, natural and man made fiber batts, in combination with other padded or quilted upholstery, has made pillowtops very bulky and rounded at the edges. High bulk material layers, such as high-density foam, directly affect the height of the mattress, and the total height when combined with a foundation and bed frame. As a result, a separate border section is used, requiring two tape edge perimeters to be sewn on each side. It is a difficult assembly to sew together around the periphery with a tape edge, requiring expert operation of a large sewing machine mounted at an oblique angle to the mattress. The sewing head must of course traverse the entire perimeter of the mattress. In the case of mattresses with bordered pillowtops, this sewing process is required four to six times, to create two tape seams for each pillowtop (both sides) and two tape seams for both sides of the mattress. The labor cost is substantial. Also, in these constructions, the interface between the mattress or upholstery of the mattress innerspring and the pillowtop is always fabric-to-fabric, as either stitching or other form of fastening is used to maintain the alignment of the pillowtop with the mattress innerspring.

Other attempts have been made to attach pillowtops to mattress innersprings. See, for example, U.S. Pat. No. 4,809,375 describing an outer mattress cover attached to a deck cover at peripheral edges by zippers; U.S. Pat. No. 4,449,261 describing a removable and reversible pillowtop attached to the mattress by peripheral fastening means, and U.S. Pat. No. 4,955,095 describing a removable one-sided pillowtop attachable to a mattress innerspring by hook and loop fasteners. The pillowtops of these designs are essentially one-sided, having an asymmetrical arrangement of internal layers, and all use a separate mechanical fastening mechanism for attachment to the innerspring. Thus the problem of set formation or compression in the pillowtop can only be addressed by detaching and fluffing rather than turning the pillow top over. The necessity of having to release multiple fasteners adds to the labor of maintaining the mattress. Most importantly, these designs are significantly more difficult and expensive to produce than conventional sewn pillowtop attachment due to the added cost of the fastening devices, plus the manufacturing operations required to add the fastening devices. Moreover, the fasteners are apparent to touch and are visually unattractive. They also restrict comfort by not allowing the pillow to function as a free and independent element relative to the innerspring. These are major disadvantages of mattress pillow tops of the prior art.

SUMMARY OF THE PRESENT INVENTION

The present invention provides a functionally integrated sleep system in which a comfort unit, containing multiple layers of fabric, fiber and foam materials, is held in place by friction upon an innerspring support unit which is placed upon a foundation. Alternatively, a separate frictional layer may be provided between a top comfort unit and an underlying support unit, wherein the top two units are maintained in alignment by the frictional property of the intermediate layer. A top surface of the innerspring support unit is constructed of a material which has a coefficient of friction with an upholstery material of the overlying comfort unit sufficient to prevent lateral or sliding movement of the comfort unit upon the innerspring support unit. This frictional engagement of the two sleep system components eliminates the need for fasteners therebetween, thus making the comfort unit usable on both sides, and easily exchangeable with comfort units of differing material construction and feel. The friction mounted comfort unit, being the only portion of the sleep system which will take a set or pronounced compression, can be freely removed from the system in a vertical direction to be flipped over or fluffed back to its original state. With the majority of comfort material layers contained in the freely mounted comfort unit, the innerspring support unit does not have to be combined with bulky material layers. The innerspring support unit provides the mechanical support function of mechanical coiling and recoiling of the individual springs in response to a load on the overlying comfort unit. The foundation provides reflexive support of both the innerspring support unit and the comfort unit.

In accordance with one general aspect of the invention, there is provided a sleep system which has a foundation unit, a support unit, and a comfort unit, wherein the comfort unit contains compressible material encapsulated in upholstery which is frictionally engaged with a supporting surface of the support unit to prevent lateral, longitudinal or sliding movement of the comfort unit when in contact with the support unit. The foundation unit includes a structural frame and one or more reflexive elements to provide a stiff flexural base for the support unit. The support unit (also referred to herein as a "support unit" or "innerspring unit") includes an innerspring made of a plurality of springs or coils connected together in an array. The support unit may alternatively be a high performance high support factor foam core structure without any internal wire or spring elements. The support unit is covered with material on an underside and perimeter sides. A top-supporting surface of the support unit is covered with a frictional material which engages the upholstery material of a comfort unit positioned upon the support unit. The comfort unit is dimensioned to fit upon the supporting surface of the support unit, and contains one or more internal layers of compressible material encased in upholstery. The frictional material on the supporting surface of the support unit is in one embodiment a non-woven fabric with a polymeric coating. The upholstery of the comfort unit is a woven material which may also have a padded backing and be quilted. Fibers of the woven fabric of the comfort unit upholstery frictionally engage with the polymeric coating of the support unit covering to prevent lateral movement of the comfort unit in contact with the support unit. The comfort unit can be lifted vertically from the support unit, without release of any fasteners, to be turned over or replaced with a different support unit, e.g., having different internal padding materials or mechanical or electrical or electronic features such as vibration/massage, heat generation, pressure sensing, pressure application with controlled air bladders, or other internal monitoring or comfort adjustment devices or mechanisms.

In accordance with another aspect of the invention, there is provided a modular sleep system which includes a foundation unit, a support unit having an innerspring with a plurality of coiled springs, and a comfort unit frictionally engaged upon a support surface of the support unit. The comfort unit contains substantially all of the compressible material of the sleep system, such as foam and fiber layers, woven and non-woven. The comfort unit is freely removable from the support unit in a vertical direction, without detachment of any fasteners, to readily enable flipping, rotation or exchange with a different comfort unit. The support unit, having an innerspring core of wire-formed springs or coils, does not take a permanent set and therefore is not required to be turned. The substantial weight of the support unit is left stationary upon the foundation unit, while the comfort characteristics of the sleep system are maintained by handling only of the comfort unit. The frictional engagement of the upholstery of the comfort unit with a coated or frictional material which covers the supporting surface of the support unit prevents lateral movement or sliding of the comfort unit relative to the support unit. A conventional fitted bed sheet fits over both the comfort unit and the support unit.

These and other aspects of the present invention are herein described in further detail, with reference to the accompanying Figures, the illustrated embodiments being representative of only some of they ways in which the principles and concepts of the invention can be executed and employed.

DETAILED DESCRIPTION OF PREFERRED AND ALTERNATE EMBODIMENTS

Figure 1:
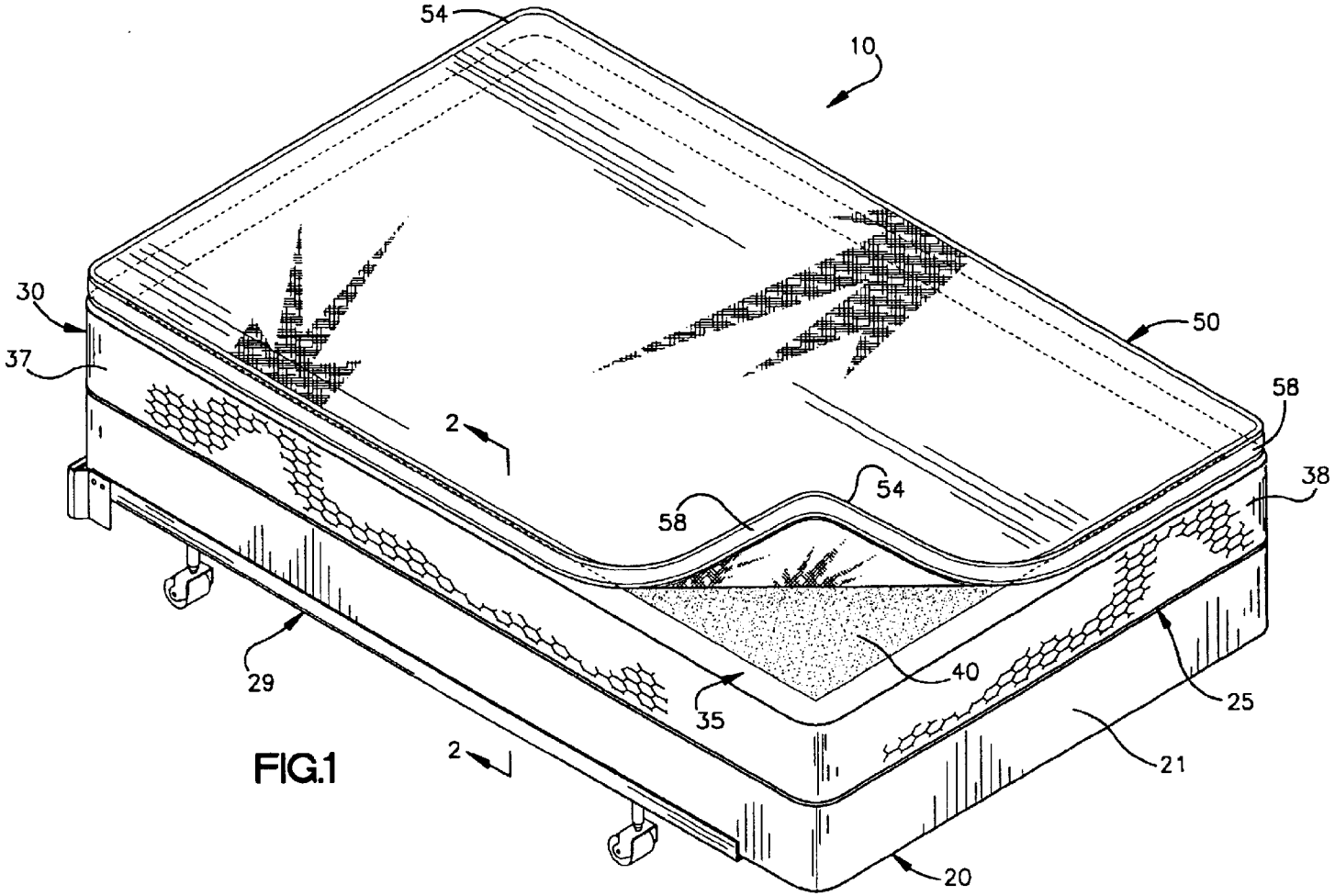
FIG. 1 is a perspective view of a sleep system of the present invention.
Figure 2A:
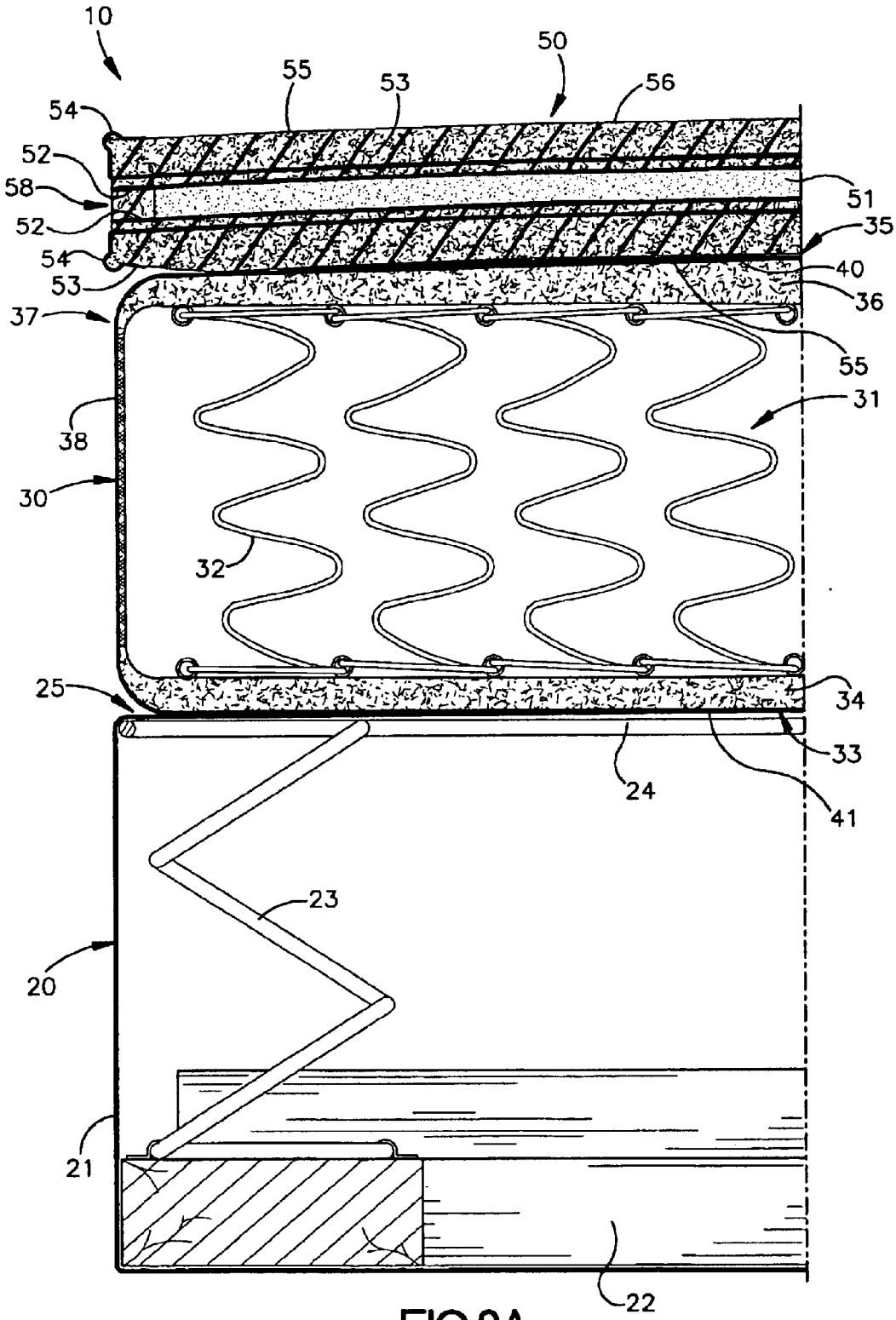
FIGS. 2A, 2B and 2C are cross-sectional views of alternate embodiments of the sleep system of the present invention.

With reference to FIGS. 1 and 2, there is shown a sleep system, generally indicated at 10, which includes a foundation unit 20, a support unit 30, and a comfort unit 50. The foundation unit 20 is shown covered with upholstery 21, and can be of conventional internal design and construction, having a rectangular frame 22 on which are mounted a plurality of spring elements or modules 23 which provide flexible support of an overlying grid or matrix 24, which defines the foundation surface 25. This basic construction is shown, for example, in U.S. Pat. No. 5,558,315 wherein the spring modules are formed of wire, and in U.S. Pat. No. 5,720,471, wherein the spring modules are made of composite material in the form for example as shown in FIG. 2A. In most installations, the foundation unit 20 is supported by a bed frame 29 (FIG. 1) which may further include side boards, a head board and a foot board (not shown).

The support unit 30 is dimensioned to fit upon the foundation surface 25 to be fully supported thereby. The support unit 30 includes an innerspring 31 made of a plurality of interconnected spring coils 32. An example of one type of innerspring suitable for the support unit 30 is shown in U.S. Pat. No. 4,726,572, and another in U.S. Pat. No. 5,713,088. A bottom surface 33 of the support unit 30 is provided with somewhat minimized covering layer or layers 34, or for example a mat or relatively thin foam. Even a very thin sheer cover, with no internal layers, can be used. This minimal covering of the bottom surface 33 is due to the fact that the support unit 30 remains stationary with respect to the foundation unit 20 once the sleep system 10 is assembled. That is, the support unit 30 is not turned over to have the opposing top support surface 35 in contact with the foundation unit 20. Such turning is not required because the spring coils 32 of the innerspring 31 do not take a set or enter a permanently compressed state under normal use. Similarly, the support surface 35 has relatively few layers of material which cover the innerspring 31, such as one or two or more layers 36 of mat or foam or other sheet-like fabric or non-woven material. The primary purpose of layer(s) 36 is to provide a smooth surface over the ends of the coils of the innerspring 31.

The innerspring 31 and layers 34 and 36 are encapsulated by an outer cover 37, having a border portion 38, a top piece 40 over support surface 35, and a bottom piece 41 over bottom surface 33. The border 38 of the outer covering 37 is preferably constructed of an upholstered material, to match that of the corresponding comfort unit 20 as further described. The top and bottom pieces 40, 41 of the outer covering 37 are preferably made of a non-woven material, as these surfaces are not exposed when the sleep system is assembled. This results in very substantial cost savings in manufacturing the support unit/innerspring unit of the system, as compared to traditional mattress manufacture in which the border and both sides of the mattress are completely covered in expensive embroidered and padded upholstery material. A wide range of materials can be used for bottom piece 41, as it is not exposed, and because the weight of the support unit is generally sufficient to keep the support unit in alignment with the foundation 20, regardless of the material properties.

Figure 2B:
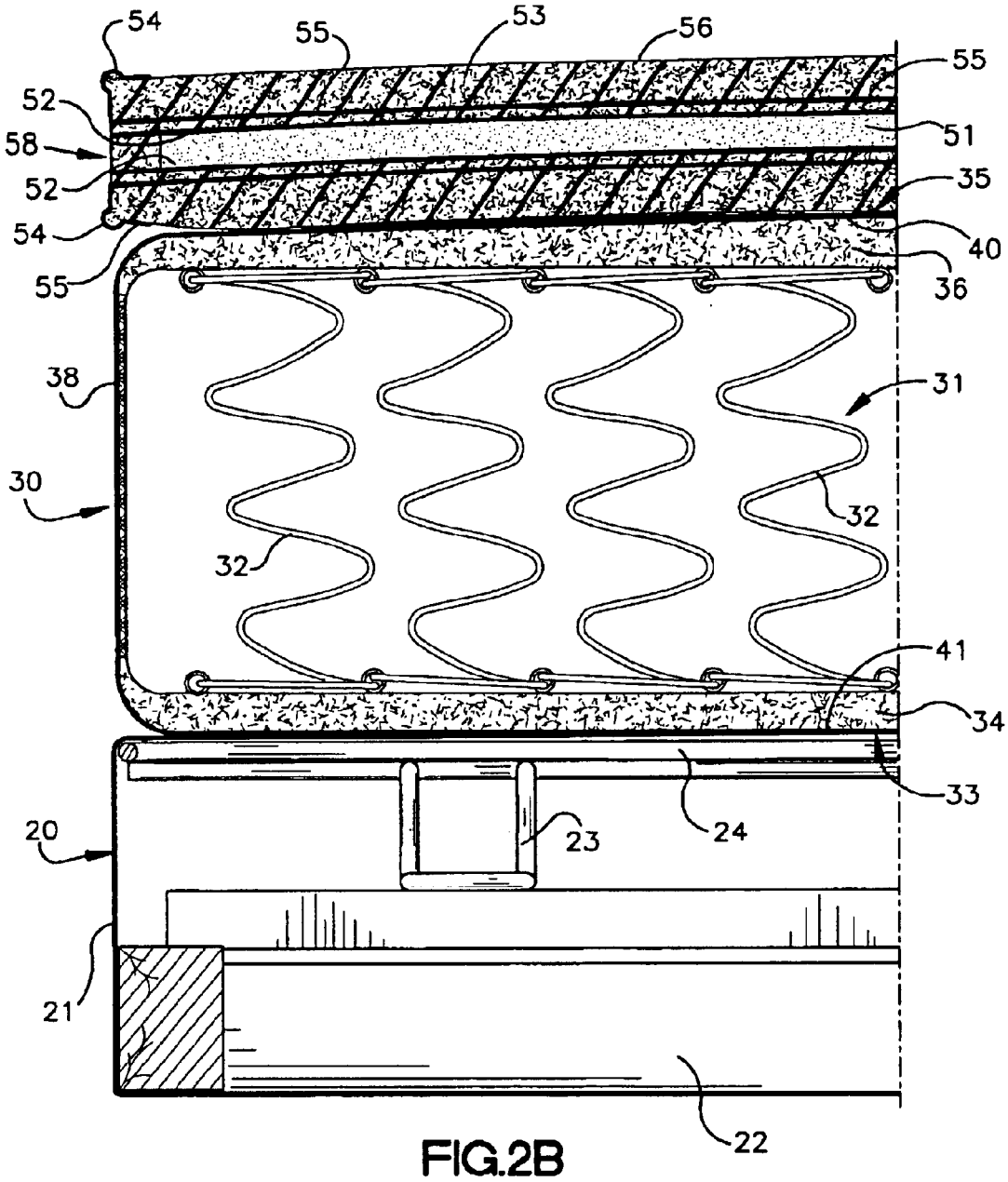
Figure 3:
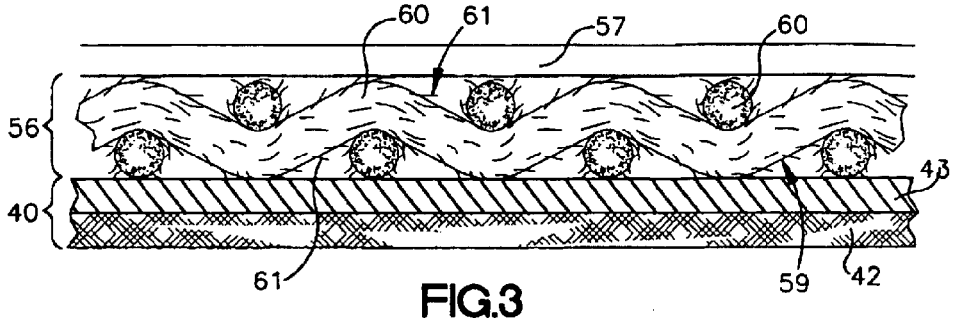
FIG. 3 is a close-up view of a friction material interface of the sleep system of the present invention.

As further shown in FIG. 3, the top piece 40 is preferably made from a non-woven material 42 with a coating 43 such as a polymer such as PVC or other materials having soft form plastic or rubber-like properties. Materials of this type provide positive lateral frictional engagement with woven fabric, which is used to cover the comfort unit 50, which resists sliding of the comfort unit 50 on the top piece 40 of the support unit 30. Alternatively, as shown in FIG. 2B, a separate layer of non-woven polymer coated or rubberized or rubber-like material may be placed upon the support surface 35 to provide frictional resistance to sliding of a comfort unit placed thereon. Alternatively, the friction material could be a woven material where the primary fibers making up the yarn and fabric have inherent high friction characteristics, such as for example a woven fabric made of PVC strands or thread.

The comfort unit 50 contains the majority of compressible, comformable internal layers of materials in the sleep system 10. As shown in FIGS. 2 and 2A, these may include one or more foam core layers 51, such as high density latex foam, convoluted foam, intermediate layers 52 of matted material, synthetic or organic, such as cotton or wool fibers, polyester, or hybrid material mats. Extra material layers 53 may also be used, such as woven cotton, wool or synthetic cloth or hybrids thereof, or sheet materials such as plastic films, solid or perforated, which may serve as moisture barriers, aeration promoters, liners, or flame or heat retarders. The comfort unit 50 may further include one or more feature layers 55, such as an electrically conductive warming layer having copper components or alternative conductive materials such as carbon or other conductive fibers, a pressure or temperature sensing layer which may contain one or more sensors, such as thin-film electronic or micro-machined electro-mechanical sensors powered from an internal or external source and connected or having a wireless data transmission connection to an external monitoring and control device; an adjustable pressure layer having one or more inflatable/deflatable air or fluid bladders for adjustment of pressure, density and feel of the comfort unit; a positive air flow system which forces air through the comfort layer through a perforated bladder or layer; a dynamic layer with mechanical actuation such as vibration, massage or resonance; and static specialty material layers containing therapeutic materials such as copper, magnetic ferrites or encapsulated gels.

The wide variety of different types of internal layers which can be used in the comfort unit 50 make the sleep system 10 highly versatile. The entire feel and function of the sleep system can be altered by simply exchanging the comfort unit 50 with a different comfort unit having significantly different support and functional characteristics. The relatively small size and bulk of the comfort unit 50 makes this type of exchange easy, even for larger size beds. The exchange is made possible by separating the comfort-determinative layers of the material from the underlying innerspring support structure, while enabling the two sleep system components to function cooperatively without the use of any fasteners.

Figure 2C:
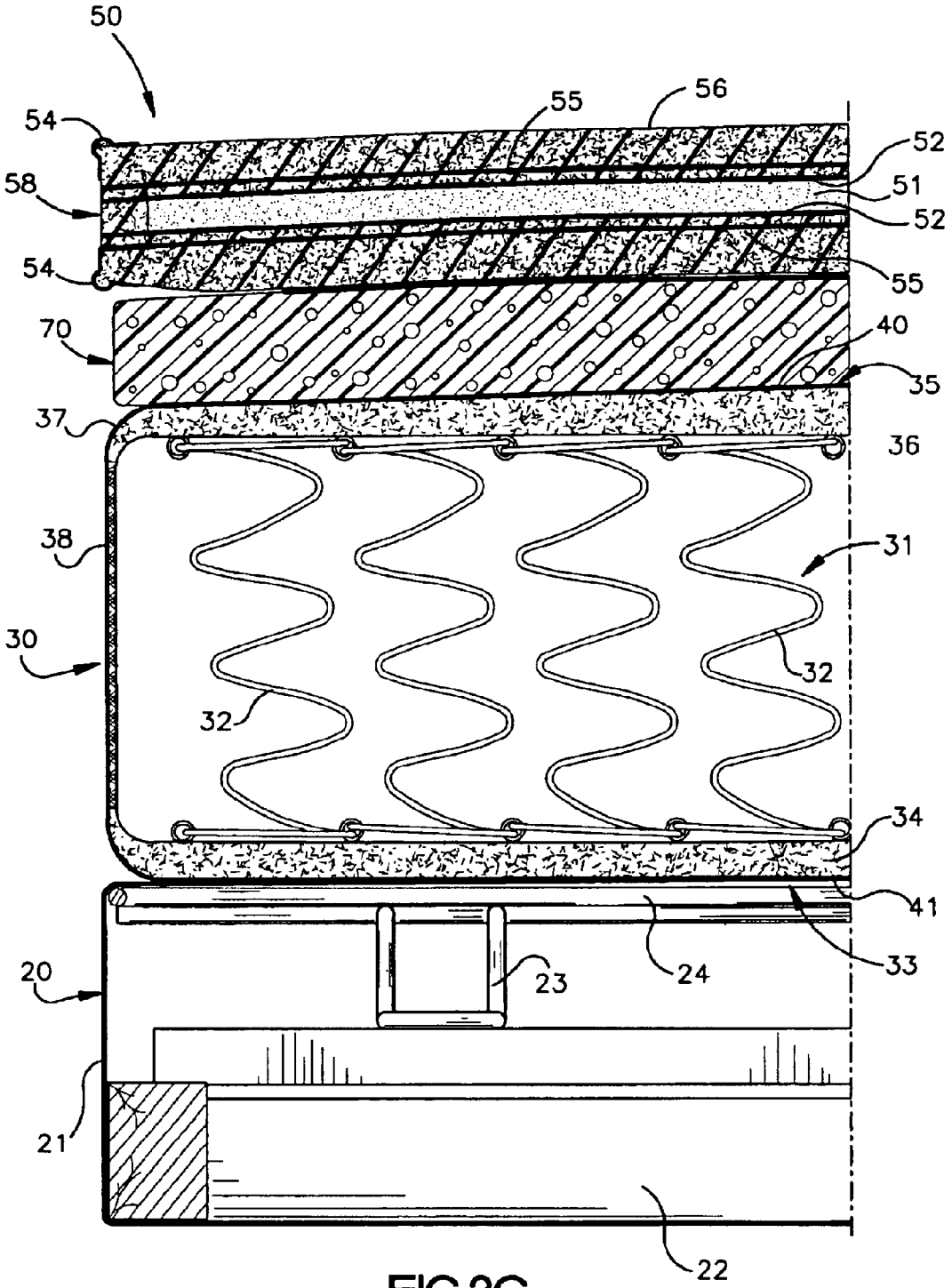

All of the layers 51–55 of the comfort unit 50 are encapsulated in a woven upholstery 56 which may have a padded backing layer 57 (FIG. 3) and be sewn with stitches in a quilted pattern. As shown in FIGS. 2A–2C, the panels of upholstery 56 are joined at the edges of the comfort unit 50 by tape seams 54. In this embodiment, there is an upper and lower tape seam 54, defining a side wall 58. The manufacture of a comfort unit 50 in this form, with multiple internal layers and two tape seams joining the upholstery panels, is far simpler than the much more complex manufacture of a pillowtop which is either permanently sewn to both sides of a mattress, or attached by a fastening system, wherein multiple fasteners must be attached to both the mattress and the pillowtop. As further shown in FIG. 3, the exterior surface 59 of upholstery 56 is that of exposed woven strands of fibers 60, such as woven cotton thread or combinations of woven cotton thread and silk thread. Individual surface fibers 61 extend from each thread in directions not aligned with the linear axes of the thread, this being a characteristic of woven fiber material. When the upholstery is placed in contact with a non-woven relatively planar surface, such as a polymer coated surface of top piece 40 of covering 37 of the support unit 30, the surface fibers 61 are compressed into substantially linear contact with the polymer coating 43 of top piece 41, as are a substantial number of the fibers which do lie along the linear axes of the woven threads. This places a large amount of fibers 61 of the woven thread in direct contact with the polymer coating 43, at random orientations in the same approximate plane. The gripping force of the polymer coating 43 in contact with the fibers 61 is sufficient to prevent lateral or sliding motion of the comfort unit relative to the top piece 41 of the support unit 30. This prevention of lateral displacement or sliding movement is all that is required to maintain alignment of the comfort unit with the support unit for normal use a sleep system. There is no need for use of any fastener means, such as zippers, straps, snaps, Velcro, ties or any other type of securement device to maintain the alignment of the comfort unit with the support unit.

Other non-limiting examples of internal and external layers of the comfort unit 50 are as follows, where the referenced "Fill" and "Border" content of the "Sleep Surface" refers to the construction components of the comfort unit 50.

1. Sleep Surface (PLUSH)—T-719Quilt Pattern

Quilted Panels=1 oz. Fiber+1" Regular Poly

Fill=1" Regular Poly

Border=Finish 2"

2. Sleep Surface (FIRM)—T-Loop-C Quilt Pattern

Quilted Panels=1 oz. Fiber+1" HP Poly

Fill=1" HP Poly

Border=Finish 2"

3. Sleep Surface (PLUSH)—T-719Quilt Pattern

Quilted Panels=1 oz. Fiber+1" Regular Poly

Fill=None

Border=None

4. Sleep Surface (FIRM)—T-Loop-C Quilt Pattern

Quilted Panels=1 oz. Fiber+1" HP Poly

Fill=None

Border=None

5. Sleep Surface (ULTRA PLUSH)—T-719-6 Quilt Pattern

Quilted Panels=1 oz. Fiber+1-½"×½" Super Soft Convolute+½ Regular Poly

Fill=2" Poly (1.532 Pin Convolute Set)

Border=Finish 3"

6. Sleep Surface (ULTRA FIRM)—T-Loop-C Quilt Pattern

Quilted Panels=1 oz. Fiber+½" Marvalux+½" HP Poly

Fill=Marvalux Convolute Topper Set (1-½")

Border=Finish 2"

7. Sleep Surface (PLUSH)—T-719Quilt Pattern

Quilted Panels=1 oz. Fiber+1" Super-Soft Poly

Fill=None

8. Sleep Surface (PLUSH/FIRM)

Top Bottom Different Quilts

9. Sleep Surface (PLUSH FEEL)

Viscous or Anatomical Foam Core

10. Sleep Surface (FIRM/PLUSH)

His/Her Side by Side

Because the comfort unit 50 in a typical embodiment has a relatively low total weight as compared to a traditional mattress having an steel innerspring core, and because the polymer coating 43 of the top piece 41 has no vertical bonding force upon the upholstery 56 of the comfort unit, the comfort unit 50 can be easily lifted or peeled or rolled away from the support unit in any manner or direction other than by sliding lateral displacement. This provides a modular and easily maintained sleep system in which substantially all of the comfort-providing compressible material is contained in the comfort unit 50, which can be readily and easily handled free from any mechanical attachment to the underlying support unit. Once the comfort unit 50 is positioned upon the support unit 30, it is laterally stable and can be fitted with a conventional cover sheet which extends to the bottom of the support unit 30.

In an alternate embodiment shown in FIG. 2C, a separate intermediate friction layer 70 is provided between the support unit 30 and the comfort unit 50. This may be, for example, a single slab layer of foam or other polymeric material, having inherent frictional properties which frictionally engage or otherwise grip the top support surface 35 of the support unit 30, and the upholstery 56 of the comfort unit 50. In this embodiment, the top support surface 35 of the support unit 30 may alternatively be made of a woven material which is frictionally engaged or gripped by layer 70. To the extent that the separate intermediate friction layer 70 is compressible, it augments or supplements the comfort features of the overlying comfort unit 50.

Figure 4A:
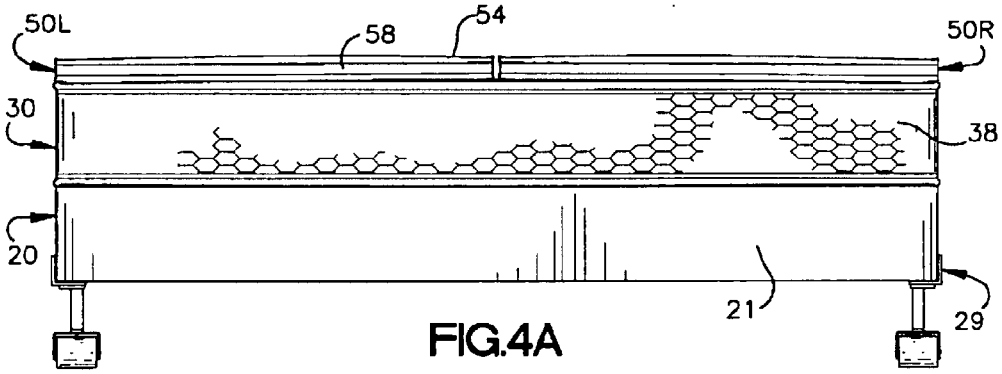
FIG. 4A is an elevation of an alternate embodiment of the sleep system of the present invention.
Figure 4B:
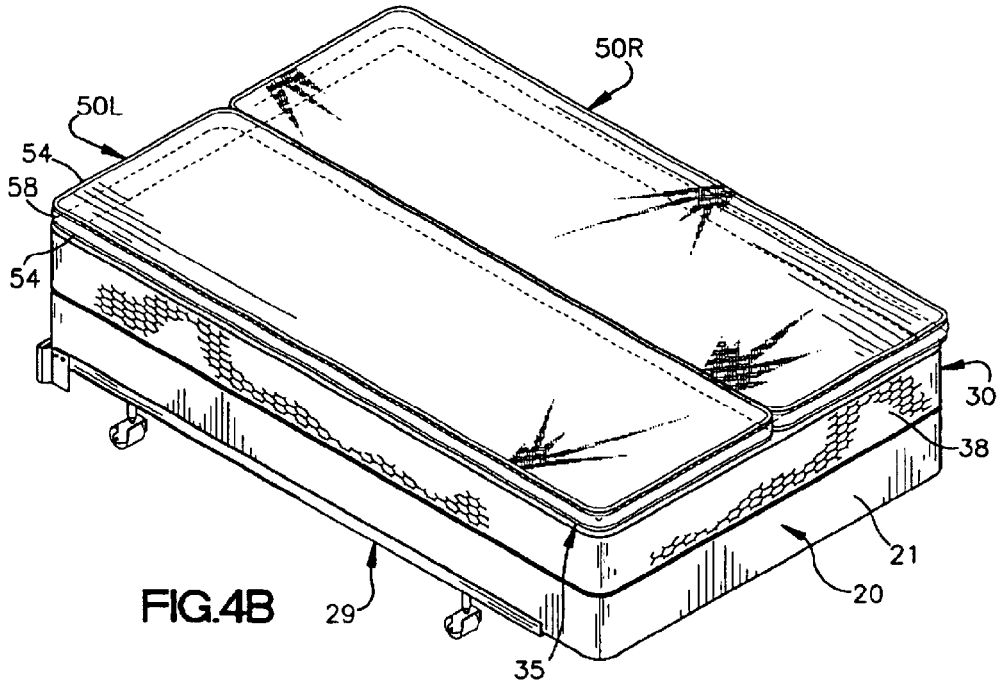
FIG. 4B is a perspective view of the sleep system of FIG. 4A.

Multiple comfort units, for example 50R and 50L, can be used with a single underlying support unit 30, as shown in FIGS. 4A and 4B. This provides a sleep system with different and adjustable side-by-side comfort characteristics. For example, one comfort unit may have a higher density foam which has a firmer feel, while the adjacent comfort unit has a lower density foam for a more plush feel. For seasonal or colder climate applications, wool layers may be provided in the comfort units. Or for warmer climates, comfort units with a positive air flow feature layer 55, in tandem or on only one side of the system.

The relatively small bulk size of the comfort units 50 enables easy handling for shipment and storage, for example in a rolled or folded configuration. Seasonal comfort units can be stored, or ordered from a supplier as needed, either as replacements or enhancements to a previously purchased sleep system. As new comfort units having new or different features are developed and produced, they can be sold in sets or separately, to new or existing customers. As a component part, the comfort units 50 can be carried out of a retail store, or ordered online and shipped by ground or air. The ability to replace the comfort unit 50 creates a virtually infinite lifespan to the support unit 30 and foundation unit 20.

Although the invention has been described with respect to certain preferred and alternate embodiments, it will be appreciated that the principles and concepts of the invention can be employed in other manners, such as any type of padding layer which is held in alignment with an underlying support unit by friction and without the use of any fasteners between the adjacent layers.

What is claimed as the invention is:

1. A sleep system comprising:

a foundation unit having a frame, a planar mounting surface, and one or more reflexive elements under the planar mounting surface, an support unit having a planar base positioned upon the planar mounting surface of the foundation unit, the support unit having a plurality of spring elements in an array, with axes of the spring elements oriented perpendicular to the planar base and to a parallel support surface of the support unit, a friction material covering the support surface of the support unit which has a coefficient of friction with upholstery sufficient to resist lateral movement of the comfort unit relative to the support surface of the support unit, and a comfort unit dimensioned to overlie the support surface of the innerspring support unit, the comfort unit having one or more layers of internal material encapsulated in an upholstery material which has a coefficient of friction when in contact with the friction material covering the support surface of the innerspring support unit sufficient to resist lateral movement of the comfort unit relative to the support unit.

2. The sleep system of claim 1 wherein the friction material covering the support surface of the support unit is a coated fabric material.

3. The sleep system of claim 2 wherein the friction material covering the support surface of the support unit is coated with a polymer.

4. The sleep system of claim 2 wherein the friction material covering the support surface of the support unit is a coated with butadiene-styrene or polyvinylchloride.

5. The sleep system of claim 1 wherein the friction material covering the support surface of the support unit is a non-woven material.

6. The sleep system of claim 1 wherein the support unit contains at least one layer of internal padding material under the friction material covering the support surface.

7. The sleep system of claim 1 wherein the upholstery material of the comfort unit is a woven material.

8. The sleep system of claim 1 wherein fabric fibers of the upholstery material of the comfort unit are in contact with the friction material covering the support surface of the support unit.

9. The sleep system of claim 1 wherein the upholstery material of the comfort unit is quilted.

10. The sleep system of claim 1 wherein the internal layers of material encapsulated in the upholstery material are made from base materials selected from the group of: wool, foam, latex, polyester, polystyrene, cotton, silk or cashmere.

11. The sleep system of claim 1 wherein the comfort unit contains a feature layer having a mechanical function.

12. The sleep system of claim 1 wherein the comfort unit contains a feature layer having an electrical function.

13. The sleep system of claim 1 wherein the comfort unit contains a feature layer having a pneumatic function.

14. The sleep system of claim 1 wherein the comfort unit contains a feature layer having a sensing function.

15. The sleep system of claim 1 wherein the coefficient of friction between the comfort unit and the support unit requires a force greater than a mass of the comfort unit to laterally displace the comfort unit relative to the support unit in sliding contact.

16. The sleep system of claim 1 wherein the comfort unit is constructed with a single tape edge.

17. The sleep system of claim 1 wherein the comfort unit is constructed with two tape edges and a side wall between the tape edges.

18. The sleep system of claim 1 wherein the comfort unit is comprised of two tandem comfort units on a single support unit.

19. The sleep system of claim 1 wherein the reflexive elements of the foundation unit are made of composite material.

20. The sleep system of claim 1 wherein the frame of the foundation comprises one or more steel members.

21. The sleep system of claim 1 wherein a thickness dimension of the support unit is greater than a thickness dimension of the foundation unit.

22. The sleep system of claim 1 further comprising a separate layer of frictional material between the support unit and the comfort unit which is not encapsulated within the upholstery material of the comfort unit.

23. A support unit for use in combination with an overlying comfort unit, the support unit having a plurality of interconnected spring elements having a generally helical form and defining a flexible support surface for supporting a comfort unit thereon, the support surface of the support unit being at least partially covered by a polymer coated material having a coefficient of friction with a woven upholstery material of a comfort unit sufficient to resist sliding of the comfort unit in contact with the support surface of the support unit wherein the comfort unit comprises at least two symmetrically arranged layers of material encapsulated in upholstery material, and wherein the upholstery material is in contact with the polymer coated material of the support unit.

24. A support unit for use in combination with an overlying comfort unit, the support unit having a plurality of interconnected spring elements having a generally helical form and defining a flexible support surface for supporting a comfort unit thereon, the support surface of the support unit being at least partially covered by a polymer coated material having a coefficient of friction with a woven upholstery material of a comfort unit sufficient to resist sliding of the comfort unit in contact with the support surface of the support unit, wherein the comfort unit comprises at least two symmetrically arranged layers of material encapsulated in upholstery material, wherein the upholstery material is in contact with the polymer coated material of the support unit, and wherein the comfort unit contains a greater number of layers of material than the support unit.

25. A support unit for use in combination with an overlying comfort unit, the support unit having a plurality of interconnected spring elements having a generally helical form and defining a flexible support surface for supporting a comfort unit thereon, the support surface of the support unit being at least partially covered by a polymer coated material having a coefficient of friction with a woven upholstery material of a comfort unit sufficient to resist sliding of the comfort unit in contact with the support surface of the support unit wherein the comfort unit is positioned on a support surface of the support unit, a bottom surface of the support unit is positioned on a foundation unit, and wherein the foundation unit is comprised of a frame and spring elements.

26. A support unit for use in combination with an overlying comfort unit, the support unit having a plurality of interconnected spring elements having a generally helical form and defining a flexible support surface for supporting a comfort unit thereon, the support surface of the support unit being at least partially covered by a polymer coated material having a coefficient of friction with a woven upholstery material of a comfort unit sufficient to resist sliding of the comfort unit in contact with the support surface of the support unit wherein the comfort unit is positioned on a support surface of the support unit, a bottom surface of the support unit is positioned on a foundation unit, the foundation unit is comprised of a frame and spring elements, and wherein the spring elements of the foundation unit are comprised of composite material.

27. A multi-unit sleep system having at least three stacked cooperating units, each unit having a different internal and external construction, the system comprising:

a) a foundation unit having a frame for supporting a plurality of spring modules, the spring modules supporting a foundation surface which forms a flexible platform for flexible support of a support unit;

b) a support unit positioned on the foundation surface of the foundation unit, the support unit having a generally planar array of interconnected springs defining a bottom surface and a top surface, the array of interconnected spring covered with material, wherein the material which substantially covers the top surface has a polymeric coating, the bottom surface of the support unit being positioned upon the foundation surface of the foundation unit, and c) a comfort unit configured for placement upon the top surface of the support unit, the comfort unit having at least two planar layers of internal material covered with woven upholstery material on each planar side, with the woven upholstery material sewn about a perimeter of the comfort unit to encapsulate the internal layers, the woven upholstery material having a coefficient of friction with the polymeric coated top surface of the support unit which resists sliding of the comfort unit on the top surface of the support unit.

28. The sleep system of claim 27 wherein the spring modules of the foundation unit are made of composite material.

29. The sleep system of claim 27 wherein the foundation unit has a thickness less than a thickness of the support unit.

30. The sleep system of claim 27 wherein the frame of the foundation unit contains steel members.

31. The sleep system of claim 27 wherein the springs of the support unit are generally helical, and arranged with linear axes of the springs parallel.

32. The sleep system of claim 27, wherein the springs of the support unit have varying configurations.

33. The sleep system of claim 27 wherein the support unit further comprises at least one layer of material between the bottom surface and the material covering the bottom surface.

34. The sleep system of claim 27 wherein the support unit further comprises at least one layer of material between the top surface and the material covering the top surface.

35. The sleep system of claim 27 wherein the material which substantially covers the top surface is a non-woven material coated with a polymeric material.

36. The sleep system of claim 35 wherein material which covers sides of the support unit is woven material which is sewn to the non-woven polymeric coated material which substantially covers the top surface of the support unit.

37. The sleep system of claim 36 wherein the woven material which covers the sides of the support unit is sewn to the non-woven polymeric coated material which substantially covers the top surface of the support unit proximate to an intersection of the top surface with the sides.

38. The sleep system of claim 27 wherein cover material on the sides is joined to cover material over the bottom surface with a tape edge.

39. The sleep system of claim 27 wherein the cover material on the bottom of the support unit is a woven material.

40. The sleep system of claim 27 wherein the cover material on the bottom of the support unit is a non-woven material.

41. The sleep system of claim 27 wherein the support unit has a differing number of layers of internal material between the top surface and the cover material and the bottom surface and the cover material.

42. The sleep system of claim 27 wherein the comfort unit has a symmetrical arrangement of internal materials.

43. The sleep system of claim 27 wherein the comfort unit has at least two different types of internal material.

44. The sleep system of claim 27 wherein the comfort unit further comprises at least one feature layer within the woven upholstery material.

45. The sleep system of claim 27 wherein the comfort unit further comprises a perimeter border wall of woven upholstery material between the planar sides, wherein the border wall is joined to edges of the planar sides of woven upholstery material by tape seams.

46. The sleep system of claim 27 comprising two comfort units positioned in tandem on the top surface of the support unit.

47. A modular sleep system having stacked unconnected planar units with differing construction and support characteristics to provide selective assembly of a modular sleep system, the system comprising:

a) a foundation unit having a frame and a plurality of spring modules defining an upper planar foundation platform;

b) a support unit configured to be placed upon the foundation platform of the foundation unit, the support unit having a plurality of interconnected springs defining a planar bottom surface and a parallel planar top surface, the interconnected springs being at least partially covered with a woven material, c) a non-woven material on the top surface of the support unit, and d) a comfort unit dimensioned to be placed upon the non-woven material on the top surface of the support unit, the comfort unit having at least two layers of internal material covered by a woven upholstery material, the non-woven material on the top surface of the support unit having a gripping force on the woven upholstery material of the comfort unit which resists movement of the comfort unit relative to the support unit.

* * * * *